US011535998B2

(12) United States Patent
Birtele

(10) Patent No.: US 11,535,998 B2
(45) Date of Patent: Dec. 27, 2022

(54) SYSTEM AND METHOD FOR INJECTING EXPANDING RESINS INTO SOILS TO BE CONSOLIDATED

(71) Applicant: THUR S.R.L., Verona (IT)

(72) Inventor: Andrea Birtele, Verona (IT)

(73) Assignee: THUR S.R.L., Verona (IT)

( * ) Notice: Subject to any disclaimer, the term of this patent is extended or adjusted under 35 U.S.C. 154(b) by 0 days.

(21) Appl. No.: 17/258,517

(22) PCT Filed: Apr. 30, 2019

(86) PCT No.: PCT/EP2019/061033
§ 371 (c)(1),
(2) Date: Jan. 7, 2021

(87) PCT Pub. No.: WO2020/011414
PCT Pub. Date: Jan. 16, 2020

(65) Prior Publication Data

US 2021/0156104 A1 May 27, 2021

(30) Foreign Application Priority Data

Jul. 9, 2018 (IT) ..... 102018000007020

(51) Int. Cl.
*E02D 3/12* (2006.01)
*E02D 5/46* (2006.01)

(52) U.S. Cl.
CPC ..... *E02D 3/12* (2013.01); *E02D 5/46* (2013.01); *E02D 2250/003* (2013.01)

(58) Field of Classification Search
CPC ..... E02D 3/12; E02D 2250/003; E02D 5/46
See application file for complete search history.

(56) References Cited

U.S. PATENT DOCUMENTS 3,783,624 A * 1/1974 Nakade ..... E02D 5/808 405/264
5,653,557 A 8/1997 Gruber
2012/0328375 A1* 12/2012 Perkins ..... E02D 5/74 405/244

(Continued)

FOREIGN PATENT DOCUMENTS

EP 2080836 A2 7/2009
EP 3037586 A1 6/2016

(Continued)

OTHER PUBLICATIONS

International Search Report dated Jul. 29, 2019 re: Application No. PCT/EP2019/061033, pp. 1-4, citing: EP 2 080 836 A2, U.S. Pat. No. 5,653,557 A, JP H06 299780 A, WO 2007/028534 A1, WO 2015/078722 A1, EP 3 037 586 A1 and JP 2006 144269 A.

(Continued)

*Primary Examiner* — Carib A Oquendo
(74) *Attorney, Agent, or Firm* — Cantor Colburn LLP

(57) ABSTRACT

A system for injecting expanding resins into soils to be consolidated, includes a pump apparatus which is operationally associated, at a delivery port, with a tubular element which can be inserted into a respective hole defined in the soil to be consolidated and is adapted to send to the tubular element a mixture at a preset supply pressure. The tubular element has a number of holes, at least two of the holes including respective calibrated holes.

6 Claims, 1 Drawing Sheet

(56) References Cited

U.S. PATENT DOCUMENTS

2016/0017562 A1* 1/2016 Barron ..... E02D 5/34
405/240

FOREIGN PATENT DOCUMENTS

| | | | |
|---|---|---|---|
| IT | 102006901463481 | A1 | 5/2003 |
| IT | 102011901905539 | A1 | 7/2012 |
| JP | H06299780 | A | 10/1994 |
| JP | 2006144269 | A | 6/2006 |
| WO | 2007028534 | A1 | 3/2007 |
| WO | 2015078722 | A1 | 6/2015 |
| WO | 2016011060 | A1 | 1/2016 |

OTHER PUBLICATIONS

IT Search Report dated Oct. 26, 2018 re: Application No. IT 201800007020, pp. 1-10, citing: EP 2 080 836 A2, U.S. Pat. No. 5,653,557 A, JP H06 299780 A, WO 2007/028534 A1, WO 2015/078722 A1, Ep 3 037 586 A1 and JP 2006 144269 A.

Written Opinion dated Jul. 29, 2019 re: Application No. PCT/EP2019/061033, pp. 1-8, citing: EP 2 080 836 A2, U.S. Pat. No. 5,653,557 A, JP H06 299780 A, WO 2007/028534 A1, WO 2015/078722 A1, EP 3 037 586 A1 and JP 2006 144269 A.

* cited by examiner

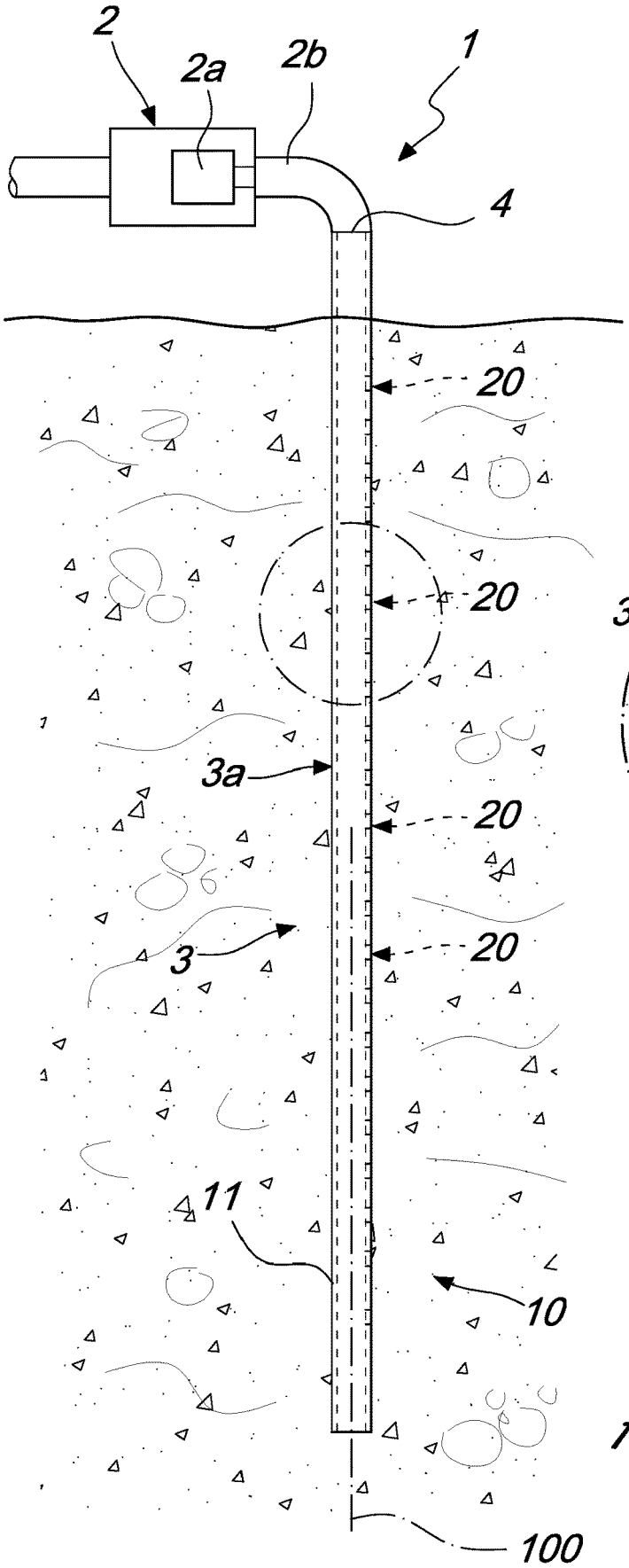
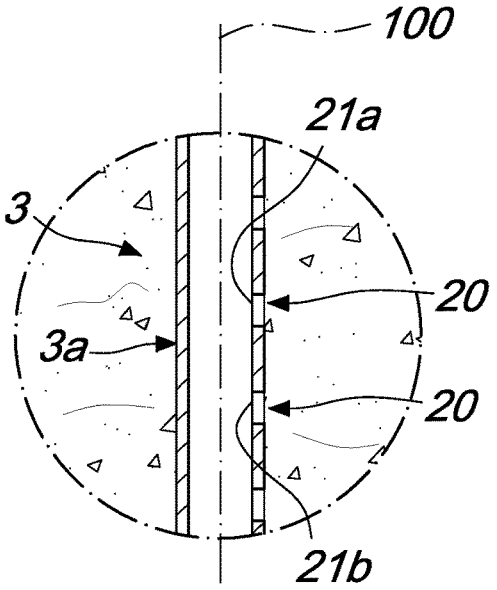
Fig. 2
Fig. 1

SYSTEM AND METHOD FOR INJECTING EXPANDING RESINS INTO SOILS TO BE CONSOLIDATED

TECHNICAL FIELD

The present disclosure relates to a system for injecting expanding resins into soils to be consolidated and a method for injecting expanding resins into soils to be consolidated.

BACKGROUND

Injection is a technique adapted to modify the mechanical characteristics (strength and deformability) and the hydraulic characteristics (permeability) of solid bodies that can be continuous or porous, fissured or containing large cavities, with the introduction of adapted natural or synthetic mixtures by way of tubes accommodated in conveniently executed holes.

The mixtures employed are fluids with rheological properties that are initially adapted to diffusion within solid bodies, which, in a certain time, take on the characteristics appropriate to the requirements of the treatment.

The solid bodies in which to carry out the injections can be granular or cohesive soils, rocks, masonry or structural elements in general.

The treatments are defined as impregnation or tamping treatments when they relate to voids that exist in nature, without appreciably altering their dimensions, while they are called cleavage or hydraulic fracturing treatments when they open fissures or cavities in the injected solid body and simultaneously fill them, forming extensive ramifications or pressure bulbs. The former relate to soils of a granular nature, fissured rocks or porous masonry, while the latter relate to fine-textured soils of a clayey or silty nature.

The purpose of the injections can also relate to the lifting of built structures, the formation of anchor bulbs for micropiles or tension bars, or the like.

The optimal treatment of a volume of soil or of masonry by way of injections of mixtures is achieved with a high number of injection points arranged in the soil or in the masonry with a very fine mesh. Furthermore, when treating a heterogeneous volume with alternating layers of variable granularity and density, it is necessary to be able to vary the amounts injected at different points as a function of the local receptiveness of the medium.

Nowadays the injections, especially of synthetic mixtures, are carried out using metal tubes of diameter comprised between 6 mm and 25.4 mm, which are provided with a single exit hole at the head. Three types of methods are adopted for this type of cannula:

fixed-point;

in advancement (downward from above);

in extraction (upward from below).

In the first case, a hole is drilled, of the same or greater diameter as that of the injection tube, and one or more cannulas of different length are accommodated in the hole (in this latter case the difference in length between the cannulas is usually equal to 1.0 m). The injection is carried out alternately in each cannula, following the sequence defined in the project. In this case, the cannulas are kept fixed in their position in the solid volume for the entire duration of the treatment. This method is very reliable but requires lengthy times and extensive work owing to the necessity to drill a large number of holes and owing to the associated operations to prepare the holes.

In the second case (used only in unusual cases and only with mixtures that have long hardening times), a section of hole is drilled, the drilling tool is withdrawn for a few meters, the injection tool is inserted to the maximum depth drilled, and the mixture is injected through the drill pipes. Then the tool is extracted and work stops while the mixture hardens. Subsequently drilling continues and the process continues in the subsequent sections with the same sequence. This method is very labor-intensive and does not permit accurate control over the result.

In the third case, the hole is drilled up to the maximum depth and the injection takes place while the injector is gradually extracted, optionally temporarily covered with a tube, from the bottom upward. This method, in addition to drawbacks in common with the previous method, also has the risk that the mixture, by rising along the lateral surface of the tube, could cement it to the soil or to the masonry, or that it could spread out uncontrollably along strata not yet treated.

Another conventional technological solution, as an alternative to the previous ones, entails fitting the holes with sleeved tubes which make it possible to vertically inject in any order, at any level and at any time interval, limited only by the hardening time of the mixture.

In this case, each drilling operation has a tube and each tube has a plurality of valves arranged along the drilled vertical hole.

The tube is usually constituted by plastic material, has a diameter typically comprised between 25.4 mm and 38.1 mm, and is provided with non-return valves arranged at intervals of 330 mm or 500 mm (3 or 2 per meter of tube).

The drilled hole has a diameter generally comprised between 65 mm and 130 mm. The annular cavity between the sleeved tube and the wall of the hole is filled with a special cement mixture, which is injected through the bottom valve and constitutes what is called the "sheath". The function of this sheath is to prevent the mixture from rising back up along the outer surface of the tube, by forcing it to affect the individual portions of soil at the level of the injecting valve. The strength of the sheath has the further function of enabling the radial breakage of the soil or of the binder contained in the masonry within a certain pressure limit applied inside the tube. The non-return valves arranged on the perforated sections of the tubes are constituted by a rubber sleeve that, by dilating under pressure, allows the outflow of the mixture and prevents its subsequent reentry.

The injection of each single valve is carried out by isolating the respective sections with an expanding double blocker lowered to the depth in the sleeved tube.

The advantages of this method are the use of a single drilled hole and a single tube for a plurality of injection points along a vertical line in the soil. The drawbacks relate to the times required to carry out the injections. Since the injections need to be carried out valve by valve, using blockers in order to prevent the clogging of the adjacent valves, the times required to complete the treatment on the entire vertical line are extremely lengthy and generate inevitable repercussions on the economy of the work site. Furthermore, the method, owing to the way it is structured, operates with mixtures that have lengthy hardening times that are such as to prevent the confinement of the material in proximity to the outlet of the valve. The precision of the treatment of injection into the soil is therefore not guaranteed in that it is not possible to evaluate the distance to which the mixture is pushed into the soil.

A variation of the foregoing method is represented by the method according to Italian patent no. 1371080, which entails the use of self-drilling hollow bars with some holes on the lateral surface, provided with coaxial sleeves of greater diameter than the bars which are also perforated on the lateral surface. Small tubes are positioned inside the bar, which are connected to valve systems which are installed inside the sleeves. The valve systems are designed so that one of the small tubes connected thereto terminates inside the system where there is a direct connection with the holes present on its lateral surface of the sleeve, while the other tubes bypass the system in order to reach the subsequent rods. The injections are carried out from the small tubes contained in the rod.

First, the injection of rapid-expanding resin into the tube is performed, the tube terminating in the valve system contained in the sleeve. This allows the resin to exit from the sleeve and, being rapid-expanding, to fan out in the immediate vicinity of the lateral surface of the bar, creating plugs in the annular cavity present between the rod and the inner surface of the hole. Subsequently a slow-expanding resin is injected into the other small tubes which terminate inside the rods. The resin that exits from the holes arranged on the lateral surface of the rod thus remains confined to the annular cavity by the plugs made previously and so it is forced to permeate or to rupture the surrounding soil without rising to the surface or blocking the holes present on the adjacent rods. With respect to the system of sleeved tubes seen above, the method described makes it possible to select the injections even for resins with very fast hardening times. The system however does not make it possible to completely overcome the defects pointed out for the previous system, and in addition it takes no account of the enormous difficulties associated with handling the injections into the tubes of small diameter placed inside the self-drilling bars.

A similar method of injection that is different from the previous ones is shown by the method disclosed in EP3037586A1, which entails the use of self-drilling hollow bars which are joined by coaxial sleeves of greater diameter than the bars. The lateral surfaces of the sleeves are passed through by holes plugged by non-return valves, similar to the sleeves described previously. The method, in reality, is not designed to spread the mixture into the soil by way of injection, but in order to provide reinforcement elements in the soil which are constituted by the bars themselves rendered integral with the surrounding body by way of injected expanding substances. The valves in fact are designed to open when the pressure of the mixture inside the bar exceeds a preset value. Therefore, the function of the injection is linked to the cementing of the bar to the soil, rather than to the consolidation of the soil. The method described differs from the previous one, in addition to the objective, also in that the injection tubes are constituted by the drilling rods and in that they are not fitted with blockers in order to select the valves that it is intended to inject. With this method the working times are considerably reduced but, against that, there is an increase in uncertainty linked both to the distance to which the mixture is pushed and, especially, to the effective opening of all the valves and therefore to the depth of injection into the soil. It happens in fact that after the opening of the valves subjected to greater pressure, i.e. the more superficial valves, the ones closest to the inlet of the mixture, the pressure inside the tube suddenly decreases to values lower than the limit for opening the subsequent valves. In this manner the expanding substance flows through the superficial valve only and does not affect the deeper layers of soil.

A method that is very similar to the previous one, although simplified, is the method disclosed in PCT application US2015/040423, which entails the on-site construction of structural piles. It entails drilling the soil and positioning a reinforcement tube with holes on the lateral surface. Inside the reinforcement tube, one or more injections of expanding resin are performed by way of one or more tubes of smaller diameter. The purpose of these injections is to make the resin come out of the holes arranged on the lateral surface of the reinforcement tube so as to cement it to the soil. The injections can be carried out with multiple injection tubes positioned at different levels inside the reinforcement tube, or with a single tube which is extracted from or introduced into the reinforcement tube during the delivery of the resin. In any case, plugs are used to select the holes on the lateral surface of the reinforcement tube from which to make the resin exit. The method, which is greatly simplified with respect to the previous one, in addition to having the objective of creating structural piles inside the soil instead of executing the injection of mixture in order to consolidate the soil, has considerable limitations which are dictated by the times and costs of implementation, as well as by the uncertainty deriving from the probable cementing by the resin of the plugs inside the reinforcement tube before concluding the method.

Another method, which does not greatly differ from the previous one, is carried out with the I-Steel system of Prematek and entails the use of a cannula with different holes on the lateral surface and of an inner tube provided with a single valve at the head. The injection is carried out in the inner tube which is first pushed up to the base of the cannula. The mixture exits from the head valve, passes through the cannula and subsequently into the soil through the hole closest to the point of delivery. During injection, the inner tube is made to slide upward inside the cannula so that the mixture progressively affects all the holes arranged on the lateral surface.

As with the previous methods, the I-Steel method is not capable of guaranteeing the outflow of the mixture from all the holes that are present on the lateral surface of the cannula. It is not unusual in fact that the mixture, instead of flowing out into the soil from the hole closest to the point of delivery, fills the interspace between the inner tube and the cannula and exits into the soil from holes arranged at different heights. The uncertainty of the result together with the costs of implementation usually discourage application of the method.

An alternative to the previous methods is represented by the injection system that entails the use of a metallic tube, on the lateral surface of which superimposed through holes are provided which have a distance between centers that decreases progressively towards the lower end of the tube. The tube is inserted into the soil after drilling and a Teflon stopper is inserted into its end. The injection is carried out by applying a nozzle to the mouth of the tube that delivers a synthetic mixture. The pressure exerted by the mixture that flows inside the tube pushes the Teflon stopper downward. When the stopper bypasses the first holes on the lateral surface of the tube, the resin flows out from the tube under pressure and fills the voids in the surrounding soil, arresting the descent of the stopper in the tube. As the amount of resin increases outside the tube, the confinement pressure from the soil increases appreciably. This entails a gradual decrease of the flow of resin toward the outside, until the holes on the lateral surface of the tube are filled. At this point the pressure exerted by the mixture resumes the downward movement of the stopper until it passes the subsequent holes on the lateral surface of the tube. At this point the outflow of resin begins into the soil and the stopper stops again.

Theoretically, this method continues autonomously until all the holes on the lateral surface of the tube are blocked. The method described is rarely used, owing to the great uncertainty represented by the stoppers which usually get stuck inside the tube and prevent completion of the injection.

Another method is known which is an intermediate solution between injection and the creation of reinforcement elements in the soil. It is used by the method described in Italian patent application no. VR2011A000004, which entails, after drilling into the soil, installing tubular elements made of plastic or other material of the corrugated type obtained from flexible reels or from rigid parts, conveniently perforated on the lateral surface in order to ensure the passage of the expanding synthetic mixture towards the outside. Accommodated inside each of these tubular elements is a metallic rod or a reinforcement bar connected at the lower end to a plate, also metallic, of greater diameter than the cross-section of the tubular element, the function of which is to keep unaltered the cross-section of the hole during the descent and so facilitate the installation of the tubular element in addition to creating an adequate expansion chamber between the wall of the hole and the lateral surface of the tubular element. Such expansion chamber serves to facilitate the polymerization reaction of the expanding resin which is injected after installing the tubular element starting from its end. After injection, in fact, the resin occupies the entire volume inside the tubular element, exits from the holes, and affects the annular cavity present between the tubular element and the lateral surface of the hole that was previously drilled in the soil, as well as the cavities present in the soil which caused the instability and the subsidence. Then, at the end of the expansion, the resin solidifies and acts as a binder for the soil, the tubular element and the inner reinforcement rod, which become a single block. This method, which is difficult to implement, exhibits serious problems associated with installing the elements and with controlling the spread of the resin into the soil.

SUMMARY

The aim of the present disclosure is to provide a system for injecting expanding resins into soils to be consolidated which is capable of improving the known art in one or more of the above mentioned aspects.

Within this aim, the disclosure provides a system for injecting expanding resins into soils to be consolidated that makes it possible to optimize the productivity of construction sites and therefore the management costs for the job.

The disclosure devises a system for injecting expanding resins into soils to be consolidated that is capable of ensuring a greater evenness of treatment, by virtue of a greater control of the spread of the mixture into the soil, so preventing it from venturing too far from the exit points and so affect volumes of soil other than those planned.

The disclosure devises a system for injecting expanding resins into soils to be consolidated that makes possible an even distribution of the resin with consequent lower development of interstitial overpressures and therefore less unwanted lifting and subsequent lowering of the overlying built structure.

This aim and these and other advantages which will become better apparent hereinafter are achieved by providing a system and by a method for injecting expanding resins into soils to be consolidated according to claim 1, optionally provided with one or more of the characteristics of the dependent claims.

BRIEF DESCRIPTION OF THE DRAWINGS

Further characteristics and advantages of the disclosure will become better apparent from the detailed description that follows of a preferred, but not exclusive, embodiment of the system for injecting expanding resins into soils to be consolidated according to the disclosure, which is illustrated for the purposes of non-limiting example in the accompanying drawings wherein:

FIG. 1 is a cross-sectional view of a soil to be consolidated with a tubular element inserted into the soil; and FIG. 2 is an enlarged-scale longitudinal cross-sectional view of a portion of the tubular element of a system according to the disclosure.

DETAILED DESCRIPTION OF THE DRAWINGS

With reference to FIGS. 1 and 2, the system for injecting expanding resins into soils to be consolidated, according to the disclosure, generally designated by the reference numeral 1, comprises a pump apparatus 2 which is operationally associated, at a delivery port 4, with a tubular element 3.

In particular, the pump apparatus 2 is adapted to send a mixture at a preset supply pressure to the tubular element 3.

The tubular element 3 can be inserted into a respective hole 11 defined in the soil to be consolidated 10.

The tubular element 3 has, at its lateral surface 3*a*, a plurality of holes 20 which are mutually spaced apart along the direction of longitudinal extension 100 of the tubular element 3.

According to the present disclosure, at least two of the plurality of holes 20 comprise respective calibrated holes 21*a*, 21*b*, 21*c*, etc. which have a respective outlet.

The system 1 further comprises an estimate of the rupture pressure of the soil (cleavage pressure) at each one of the calibrated holes 21*a*, 21*b*, 21*c*, etc.

The dimensions of the outlets of the calibrated holes 21*a*, 21*b*, 21*c*, etc. and the preset supply pressure of the mixture to the tubular element 3 are, in particular, such as to allow the outflow of the material through the respective outlets at a pressure that is higher than the cleavage pressure.

According to a preferred embodiment, the dimensions of the outlets of the calibrated holes 21*a*, 21*b*, 21*c*, etc. and the preset supply pressure are adapted to make the flow-rate of the material through the outlets substantially equal in each one of the at least two calibrated holes 21*a*, 21*b*, 21*c*, etc.

"Substantially equal" means that between various calibrated holes 21*a*, 21*b*, 21*c*, etc. the variation in flow-rate can be approximately 15%.

In this regard, it is possible for the calibrated holes 21*a*, 21*b*, 21*c*, etc. to present an outlet that increases progressively as the distance from the delivery port 4 increases.

According to a preferred practical embodiment, the pump apparatus 2 comprises an injection gun 2*a* which is connected, by way of the flexible tubes 2*b*, to the delivery port 4.

Advantageously, the injection gun comprises a mixing chamber which is connected in input to a first and to a second supply duct which are heated and are adapted to convey into the chamber, at a predefined pressure, the components of the mixture, the mixing chamber being further connected to a third duct for supplying air under pressure for the activation of the injection gun, a discharge duct being provided which is connected to the mixing chamber and is connected to said tubular element.

The switch of the nozzle is actuated manually by the operator by way of a sprung trigger or by way of an electromechanical actuator, and this determines the opening of the flow of the two components toward the mixing chamber and as a consequence generates the outflow of the mixture from the discharge duct toward the tubular element. The release of the trigger by the operator immediately interrupts the flow of the two components toward the nozzle and therefore the injection of mixture into the soil.

Preferably the injection-and-pause intervals can be extremely short, of the order of a few seconds, and more generally, comprised between 1 second and 10 seconds.

Preferably, the calibrated holes 21*a*, 21*b*, 21*c*, etc. are mutually spaced apart along the direction of longitudinal extension 100 of the tubular element 3 for the full extension of the aforementioned tubular element 3.

According to a further aspect, the present disclosure relates to a method for injecting expanding resins into soils to be consolidated 10 that comprises:

- a step of drilling the soil to be consolidated 10 in order to provide at least one hole 11;
- a step of estimating the rupture pressure of the soil (cleavage pressure) at the regions affected by the hole;
- a step of inserting, into the hole 11, a tubular element 3 which has, at its lateral surface 3*a*, a plurality of holes 20 which are mutually spaced apart along the direction of longitudinal extension 100 of the tubular element 3, at least two of the holes 20 comprising respective calibrated holes 21*a*, 21*b*, 21*c*, etc.;
- a step of supplying intermittently, by way of the pump apparatus 2, expanding resin toward the delivery port 4,
- the dimensions of the outlets of the calibrated holes 21*a*, 21*b*, 21*c*, etc. and the preset supply pressure of the resin to the tubular element 3 being such as to allow the outflow of the material through the respective outlets at a pressure that is higher than the cleavage pressure.

Conveniently, the injection is carried out by connecting an injection gun 2*a* to the delivery port 4 (or head) of the tubular element 3, and dispensing the expanding resin with well-defined parameters so that this exits from each calibrated hole 21*a*, 21*b*, 21*c*, etc. present on the lateral surface 3*a* of the tubular element 3 with a regulated flow-rate and, once it has reached the soil, spreads into the surrounding volume in a controlled manner. The injection is continued for a time necessary to detect the start of lifting of the overlying built structure or, in the absence of this, the vertical movement of the soil at the surface.

The new method therefore has two principal objectives:

- to enable the outflow of the expanding injection resin with a preset flow-rate from each calibrated hole 21*a*, 21*b*, 21*c*, etc. present on the lateral surface 3*a* of the tubular element 3 so that the speed of the expanding resin is sufficient to generate a spread into the soil by simple permeation or, in fine-grained soils, by cleavage;
- to control the spread of the expanding resin into the soil, i.e. to prevent it from venturing too far from the exit points and so affecting volumes of soil other than those planned.

In order to achieve the above advantages, it is necessary to act on the following parameters:

- pressure and flow-rate of injection;
- geometry of the holes present on the lateral surface 3*a* of the tubular element 3;
- gelification and hardening times of the mixture;
- time intervals for dispensing the mixture.

The system and method according to the disclosure is based on different principles to the conventional methods, in that:

- it does not use inner tubes which are inside the injection duct, plugs, or blockers, but simply entails, on the lateral surface 3*a* of the tubular element 3, the provision of calibrated holes 21*a*, 21*b*, 21*c*, etc. with appropriate geometry and dimensions;
- it carries out the injection by way of an injection gun 2*a* fitted onto the mouth of the tube, which ensures constant flow-rate and pressure;
- it uses a mixture, usually synthetic and expanding, which has well-defined gelification and hardening times.

To explain the principle at the base of the new system and of the new method according to the disclosure, it is necessary to analyze the behavior of the fluid in the tubular element 3 and subsequently in the soil.

The flow of the mixture through the tubular element 3 is determined by the laws of hydrodynamics.

A fluid moves inside a tube from the point of highest pressure toward the point of lowest pressure. If there are no variations of pressure between the two ends, the fluid remains under static conditions.

Bernoulli's principle, which is valid for perfect fluids (zero friction and viscosity) in a rigid conduit with steady motion (a constant flow-rate), states that for horizontal tubes the static pressure of a fluid in motion varies inversely with its speed. In other words, we can say that as long as the speed of the fluid increases, the static pressure decreases. The overall energy, given by the sum of the pressure energy, the kinetic energy and the potential energy, therefore remains constant.

Furthermore, when motion is stationary, the flow-rate remains constant, i.e. the volume of fluid that transits one cross-section of the tube in a unit of time must also transit a previous or subsequent cross-section, of different dimensions.

Accordingly, in the presence of areas of narrow cross-section, the fluid increases its speed in order to keep the flow-rate constant and as a consequence it decreases its static pressure.

Differently, if the fluid is not perfect, i.e. it presents viscosity and friction on the walls of the tube, the conditions change.

The energy expressed by Bernoulli's principle is not conserved, but decreases along the direction of the flow.

The loss of pressure or loss of "continuous" load is constituted by the amount of energy lost by the fluid in order to overcome the friction it encounters in flowing inside the tube.

In addition to the loss of continuous load, the fluid in motion is subject to further "localized" load losses, which entail sudden dissipations of energy that are due to variations in cross-section of the tube, variations in the direction of flow, outlets to the outside etc.

The distributed load losses are regulated by Darcy's law, and we can extracting the following considerations from its formulation:

- the continuous load losses increase with the length of the duct;
- the continuous load losses increase with the narrowing of the cross-section of the tube;
- the continuous load losses increase with the density of the fluid;
- the continuous load losses increase with the increase in the flow-rate (and therefore of the speed of the fluid for the same diameter of the duct);

the continuous load losses increase with the viscosity of the fluid.

By contrast, the localized load losses increase with the density of the fluid, with the flow-rate (and therefore with the speed of the fluid for the same diameter of the duct) and with the hindrances present on the inner lateral surface of the duct (sudden changes in cross-section or in direction).

The flow of a mixture through a tubular element that has holes on the lateral surface is therefore described in the following manner.

The mixture introduced into the tubular element 3 by injection starts at the height of the mouth of the tube, with a well-defined flow-rate and pressure.

Along the portion that precedes the first calibrated hole 21*a*, the mixture undergoes continuous load losses, which reduce its energy. The cross-section of the tubular element 3 is the same, so that, to conserve the flow-rate, the flow speed does not change. The decrease in energy is therefore absorbed by the potential energy and pressure energy terms of the Bernoulli equation.

At the first calibrated exit hole 21*a*, the mixture loses further energy, in this case localized, owing to the exit cross-section, and is divided into two flows: the first flow exits into the soil from the calibrated hole 21*a*, and the second flow continues downward. In this case all three of the terms that make up the Bernoulli equation decrease. The flow-rate of the first flow is defined as a function of the soil consolidation requirements and of the characteristics of the soil.

Therefore if the change in energy owing to the outlet losses is known, and the injection flow-rate for the first calibrated hole 21*a* is defined, then by the principle of conservation of flow-rate, it is possible to calculate the diameter of the second calibrated hole 21*b* to be provided on the lateral surface 3*a* of the tubular element 3 and the speed of continuation of the flow toward the subsequent calibrated holes.

Therefore if the speed and pressure of the mixture in the portion that follows the first calibrated hole 21*a* and which precedes the second calibrated hole 21*b* are known, it is possible to reiterate the same method for the subsequent calibrated holes, until the hole arranged on the bottom of the tubular element 3 is reached.

The method of calculation is easy to implement and makes it possible to determine the diameter of the calibrated holes 21*a*, 21*b*, 21*c*, etc. to be provided on the lateral surface 3*a* of the tubular element 3.

The diameter of the calibrated holes 21*a*, 21*b*, 21*c*, etc. is therefore strictly linked to the flow-rate that it is desired to provide and is the first condition to be met in order that the described system functions correctly.

A second necessary condition for the correct development of the injection relates to the possibility that the mixture exits from all the holes present on the lateral surface 3*a* of the tubular element 3 and spreads inside the soil, be it granular or cohesive, without creating obstructions.

This it is possible only if the output speed of the mixture from each calibrated hole 21*a*, 21*b*, 21*c*, etc. corresponds to a static pressure that exceeds the pressure necessary for a correct spread of the mixture.

For coarse-grained soils, by virtue of the granularity that gives them high permeability values, the exit pressure into the soil influences the correct spread of the mixture (and therefore the possible blockage of the holes) only in the long term, i.e. when most of the inter-granular voids have been filled and therefore the permeability has been reduced.

For finely-grained soils, characterized by very low initial permeability values, the value of the exit pressure assumes a key role right from the start of the process. It must always be greater than the hydraulic fracturing pressure, which allows the free spread of the mixture and prevents the blockage of the holes.

The last condition to be met so that the new system and the new method operate correctly is linked to the propagation distance of the mixture into the soil. It happens in fact that the process of hydraulic fracturing of the soil, necessary in order not to clog the calibrated holes 21*a*, 21*b*, 21*c*, etc. arranged on the lateral surface 3*a* of the tubular element 3, triggers the propagation of fissures within the soil. These fissures, fed by the mixture that flows from the cannula, tend to propagate in the soil in an uncontrolled manner.

For this reason it is necessary to calibrate some parameters, which on the one hand impede the clogging of the holes and on the other hand it make it possible to manage with precision the distance from the exit point into the soil that the mixture can travel, which are:

gelification and hardening times of the mixture;

injection times.

The gelification and hardening times of the mixture make it possible to obtain a first calibration of the method of injection, in that they must be sufficiently lengthy to not clog the holes but at the same time they must be limited in order to not excessively disperse the mixture into the soil.

Obviously the gelification and hardening times of the mixture alone are not sufficient to best manage the process of spreading the mixture into the soil, since each site has different characteristics from the next and the parameters of the mixture are not continuously modifiable.

Hence it is necessary to avail of an additional parameter that makes it possible to refine the process: the injection time.

As already anticipated, each injection is performed intermittently, i.e. for each process, time intervals in which the mixture is dispensed continuously are alternated with intervals in which the injection is suspended. In this manner it is certain that the injected mixture will exit from the calibrated holes 21*a*, 21*b*, 21*c*, etc. with a greater pressure than the hydraulic fracturing pressure and simultaneously that it will not venture too far from the injection point. The injection suspension intervals are in fact defined so that the mixture injected up to that moment begins the process of gelification before the arrival of the subsequent mixture and therefore the pressure necessary for the same fracture to spread in the soil grows until it exceeds the hydraulic fracturing pressure. In this manner the mixture that is subsequently dispensed, instead of following the same fracture created previously, describes a new fracture, remaining confined adjacent to the outlet of the injection hole.

In practice it has been found that the disclosure fully achieves the intended aim and advantages by providing a system and method that make it possible to control the outflow of the injection mixture with a preset flow-rate from each calibrated hole present on the lateral surface of the tubular element, so that the speed of the mixture is sufficient to generate a spread into the soil by simple permeation or, in fine-grained soils, by cleavage.

Furthermore, the system and method according to the disclosure makes it possible to control the spread of the mixture into the soil, i.e. to prevent it from venturing too far from the exit points and so affecting volumes of soil other than those planned.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102018000007020 from which this application claims priority are incorporated herein by reference.

The invention claimed is:

1. A method for injecting expanding resins into soils to be consolidated, the method including the following steps:

drilling a soil to be consolidated in order to provide at least one hole, estimating a rupture pressure of the soil at regions affected by said hole, providing a system for injecting expanding resins into said soils to be consolidated, said system comprises: a pump apparatus operationally associated, at a delivery port, with a tubular element having, at a lateral surface thereof, a plurality of holes mutually spaced apart along a direction of longitudinal extension of said tubular element, wherein at least two of said plurality of holes comprise respective holes which have an outlet, said pump apparatus being adapted to supply intermittently said expanding resin toward said delivery port, calculating a rupture pressure of the soil at each one of said plurality holes, inserting, into said at least one hole, said tubular element and supplying intermittently, by way of said pump apparatus at a preset supply pressure, said expanding resin toward said delivery port, providing dimensions of the outlets of said plurality holes and the preset supply pressure of the resin to said tubular element so as to provide an outflow of the mixture through the respective outlets at a pressure that is higher than said rupture pressure, and so as to provide a substantially identical flow-rate of the mixture passing through each one of said at least two holes.

2. The method according to claim 1, wherein said at least two holes have the outlet with a dimension that increases progressively as a distance from said delivery port increases.

3. The method according to claim 1, wherein the dimensions of the outlets of said at least two holes and said preset supply pressure are adapted to ensure a substantially identical flow-rate of the mixture passing through each one of said at least two holes.

4. The method according to claim 1, wherein said pump apparatus comprises an injection gun connected by a flexible hose to said delivery port.

5. The method according to claim 4, wherein said injection gun comprises a mixing chamber connected in input to a first supply duct and to a second supply duct which are heated and are adapted to convey into said chamber, at a predefined pressure, components of said mixture, said mixing chamber being further connected to a third supply duct configured for supplying air under pressure for the activation of said injection gun, a discharge duct being provided which is connected to said mixing chamber and is connected to said tubular element.

6. The method according to claim 1 wherein the dimensions of holes are calculated on the basis of distributed load losses and of localized load losses.

* * * * *